United States Patent [19]

Hanson et al.

[11] 4,131,084

[45] Dec. 26, 1978

[54] UPRIGHT DIRECT FIRED WATER BATH PROPANE VAPORIZER

[75] Inventors: Robert C. Hanson, Excelsior; Leon C. Hanson, Bloomington, both of Minn.

[73] Assignee: Energy Systems, Incorporated, Eden Prairie, Minn.

[21] Appl. No.: 785,409

[22] Filed: Apr. 7, 1977

[51] Int. Cl.[2] ..... F22B 1/02; F22D 5/08; F22D 5/26

[52] U.S. Cl. ..... 122/33; 122/451 R; 62/52

[58] Field of Search ..... 122/32, 33, 451 R; 62/52

[56] References Cited

U.S. PATENT DOCUMENTS

| | | | |
|---|---|---|---|
| 3,398,721 | 8/1968 | Zangl | 122/33 |
| 3,603,101 | 9/1971 | Sullivan | 122/33 |
| 3,793,993 | 2/1974 | Teagan | 122/33 |
| 3,897,754 | 8/1975 | Jerde | 122/33 |

*Primary Examiner*—Kenneth W. Sprague
*Attorney, Agent, or Firm*—Burd, Braddock & Bartz

[57] ABSTRACT

A water bath vaporizer for converting liquid propane into gaseous propane includes a propane-carrying heat transfer pipe in the form of a helix immersed in a water bath in an insulated upright cylindrical water chamber. Multiple straight vertical flues are integral with a bottom plate and a top plate of the water chamber and are open through the water bath and the center of the helix to carry combustion products and heated air from a combustion chamber to a stack above. Liquid propane is introduced at the top of the helix and gaseous propane is removed from the bottom and is discharged vertically upwardly through a liquid cut-off float valve which prevents flow of liquid propane out of the vaporizer. A breather attachment includes a breather pipe having a first section extending outwardly from a top portion of the water chamber at a slight upward angle and having a vertical second section terminating in an upwardly opening outer end. A vent cap over this open end is removable to add make-up water to the water chamber. Spaced apart heat conducting fins extend outwardly from the first section and cool it so that vapors from the water bath will be condensed and flow back into the bath. The vaporizer and a control box are located within an enclosure. The control box is located above the fire box and has a removable control box access panel or door which is louvered top and bottom to provide drying and ventilation of the controls and to provide combustion air to the burner.

10 Claims, 6 Drawing Figures

FIG. 4
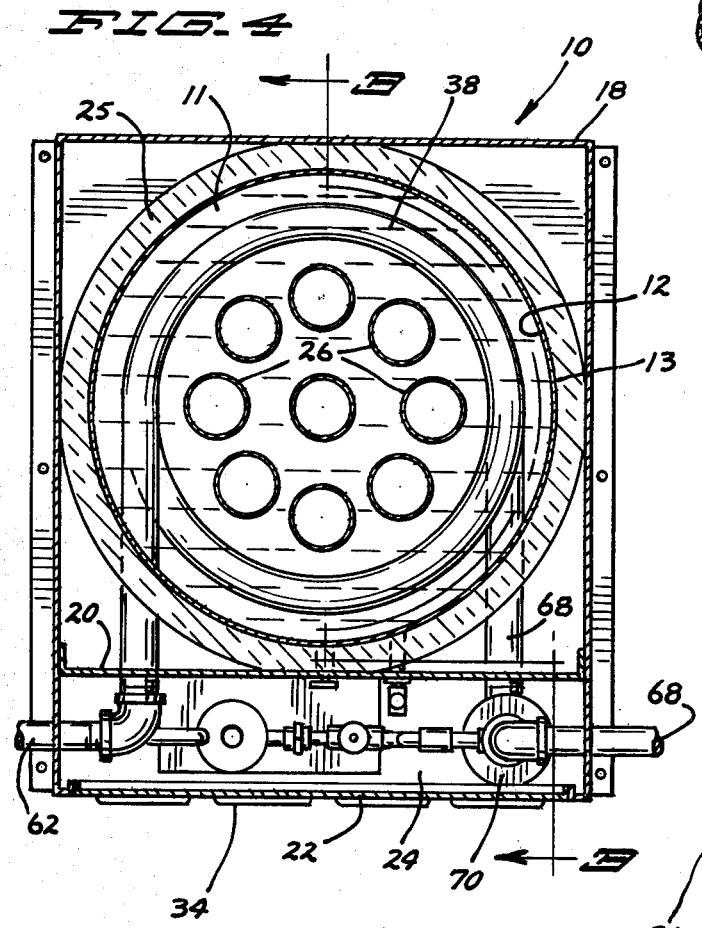
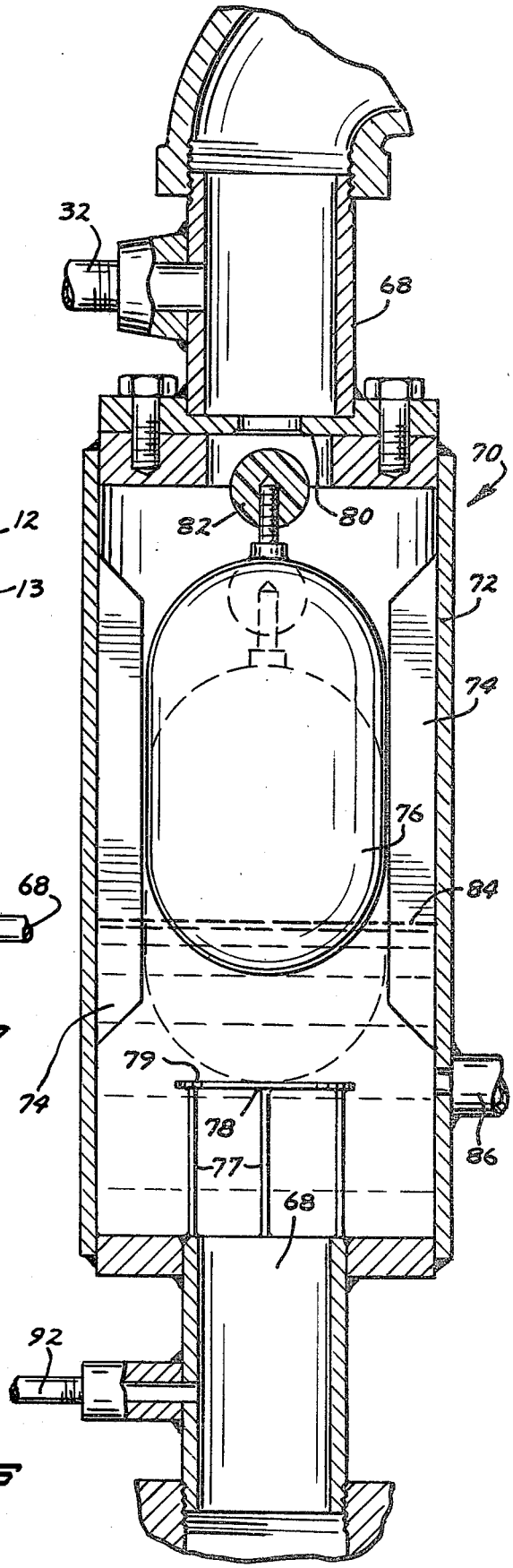
FIG. 5

UPRIGHT DIRECT FIRED WATER BATH PROPANE VAPORIZER

BACKGROUND OF THE INVENTION

This invention relates to a vaporizer for converting propane in its liquid phase to propane under pressure in its gaseous phase. The invention is equally applicable to converting any other compound, mixture or element from liquid to gaseous phase where the material can be maintained in liquid phase under pressure and is normally in a gaseous phase at pressures near atmospheric.

Vaporizers capable of processing in the neighborhood of from 100 to 600 gallons per hour of liquid propane into gaseous propane are often employed as primary gas generator units or as standby units to supplement or temporarily replace supplies of gas from pipe lines. Such vaporizers must sometimes stand idle for extended periods; but must be highly reliable to supply gas without failure or interruption on very short notice.

Before the present invention, units designed to fulfill similar requirements have tended to be unreliable. Factors contributing to unreliability included the necessity or desirability of installing such vaporizers outside or, if inside, at locations where moisture is present in the ambient air. Because of this, condensation often resulted from temperature changes occurring from alternate operation and shut-down of the vaporizer and from changes in weather conditions, and so rusting and other corrosion was present.

Controls often kept in damp and cold (sometimes freezing) environments and necessarily operated without opportunity for warming and/or drying often malfunctioned or broke down.

The relatively cold temperature of the pipe carrying liquid propane to the vaporizer tends to cause condensation of any and all moisture coming in contact with it and this condensation drops from such pipe to have a rusting or other corrosive effect on the areas it contacts unless provisions are made to evaporate it and drive it off.

Specifically, temperature sensors, electronic controls, electronic and fluid control conduits, and control boxes in which they have been installed have rapidly deteriorated due to the attack of moisture thereon.

Within the heat exchange portion of the vaporizer itself, a problem has been the stratification into thermal layers of the water or other heat transfer liquid. The introduction of cold liquid propane into a heat transfer pipe in such a manner as to cause circulation of the water within the heat exchanger and to prevent stratification of the heat in the water would maximize the heat transfer effect.

Also, the flow of liquid propane into the heat transfer pipe in a heat transfer medium, the flow of propane through the heat transfer pipe and the flow of gaseous propane out of this pipe after vaporization has taken place, at flow rates of more than 100 gallons (378.5 liters) of liquid per hour to less than 600 gallons (2.271 kiloliters) per hour, tends to be a laminar flow. This is not as favorable for efficient heat transfer as would be a turbulent flow. The supply of cold liquid propane in such a manner as to cause greatest turbulence of the propane as it proceeds through the coil would further maximize the heat transfer effect.

The providing of the maximum area of contact between the flues carrying the products of combustion and heated air and the heat transfer liquid in the water bath without inhibiting the draft effect of the vertical upward passage of these combustion products would also tend to maximize the heat transfer.

No search of the prior art was made before the preparation and filing of this patent application. However, applicants are not aware of any prior art that anticipates the claims made herein.

BRIEF SUMMARY OF THE INVENTION

A vaporizer for converting a stored liquid material into gaseous phase includes a heat transfer pipe in the form of a helix supported in a liquid heat transfer bath in a heat transfer chamber to have the major axis of the helix situated in vertical alignment. A combustion chamber is provided below the liquid heat transfer chamber, and a stack is provided above it. A plurality of vertical flues extend through the heat transfer chamber and through the center of the helix to allow passage of heated air and products of combustion from the combustion chamber to and through the stack. Liquid to be vaporized is introduced into the top of the heat transfer pipe of the helix, is heated to pass from liquid phase to vapor phase as it passes downwardly through the coils of the helix, and the gas which has been vaporized is carried from the bottom of the helix and discharges upwardly through a liquid blocking float valve which is operative to prevent discharge from the outlet end of the heat transfer pipe as long as and whenever there is a substantial amount of unvaporized liquid in the float chamber, thereby preventing liquid from entering downstream devices designed for vapor only.

The heat transfer chamber is insulated on all sides except the bottom where it is adjacent to the combustion chamber. The entire vaporizer is enclosed in a casing. This casing also defines a control box housing operational controls including the liquid blocking cut-off valve, and through which the liquid supply pipe and the gas delivery pipe extend or pass. A removable control box cover panel or door is provided in spaced relation to the insulated heat transfer chamber, and louvers are provided at the bottom of that panel or door to allow combustion air to the combustion chamber and to allow access of air to the control box. Louvers are also provided in the top of the panel to allow air heated by the combustion chamber and/or through the insulated wall of the vaporizer to pass through the control box along the electrical controls, the liquid inlet pipe, the gas outlet pipe and the gas controls and valves to warm, vaporize and carry off any moisture in the control box to the outside of such enclosure.

IN THE DRAWINGS

FIG. 4 is a horizontal sectional view at somewhat reduced scale taken on the line 4—4 in FIG. 3;

FIG. 5 is an enlarged vertical sectional view taken on the line 5—5 in FIG. 3.

DESCRIPTION OF PREFERRED EMBODIMENT

Figure 2:
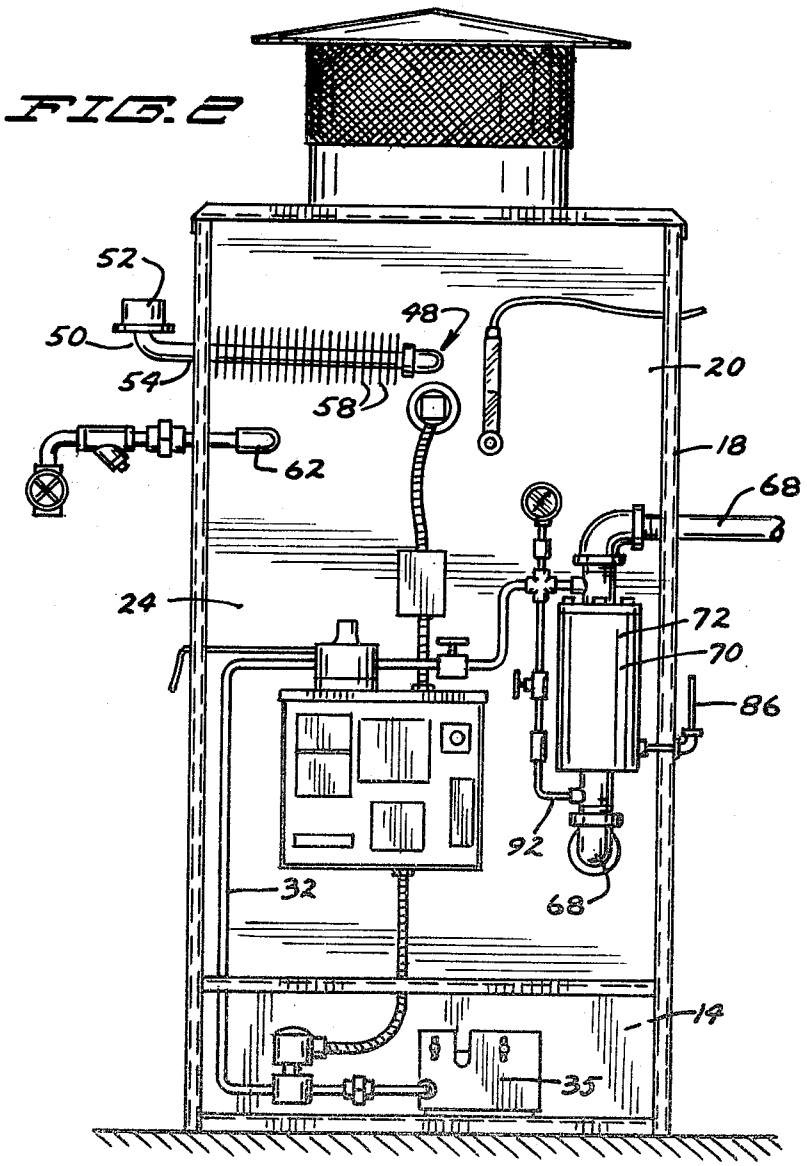
FIG. 2 is a front elevational view of the vaporizer of FIG. 1 but with a control box cover panel removed.
Figure 1:
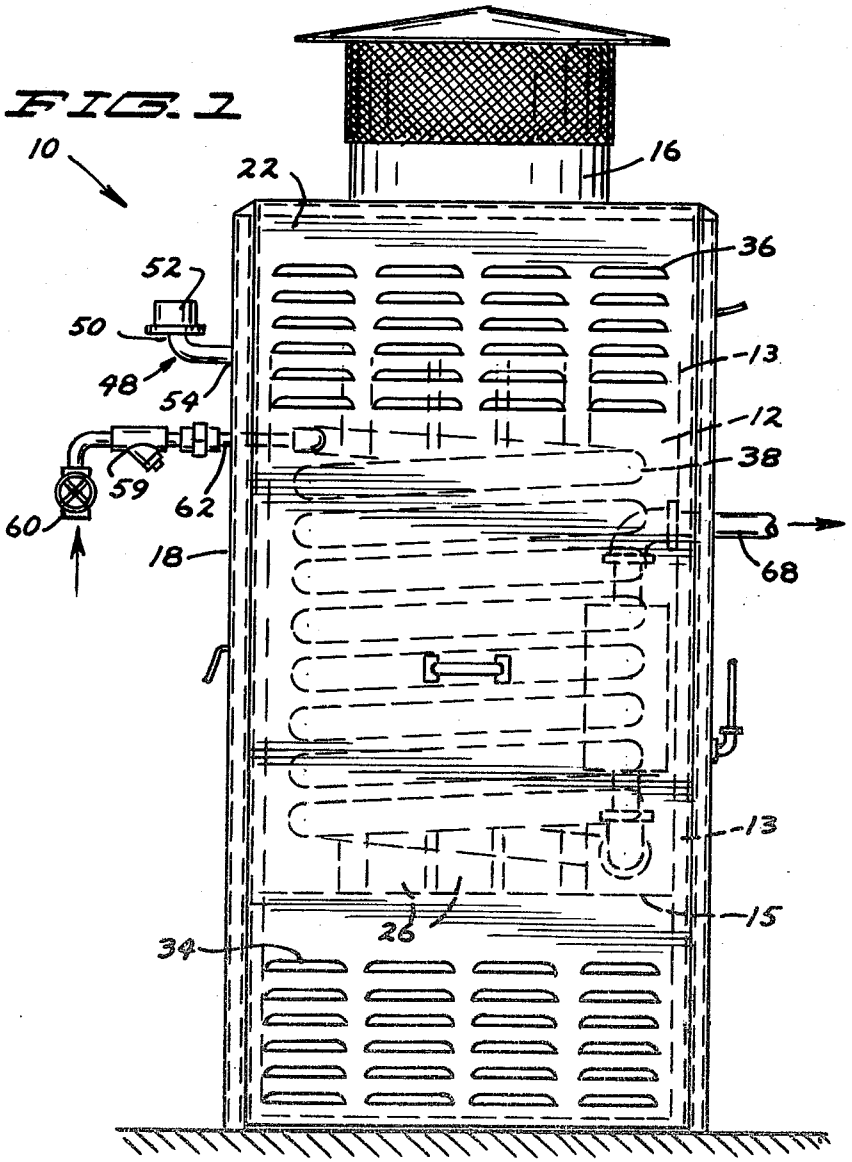
FIG. 1 is a front elevational view of an upright direct fired water bath propane vaporizer of the invention with a helically wound heat transfer pipe, portions of a water chamber, and portions of flues extending through that water chamber shown in phantom.

An upright direct fired vaporizer 10 includes an upright cylindrical water chamber 12, a fire box or combustion chamber 14 below the water chamber, and a stack 16 extending upwardly from the water chamber. The water chamber is filled with a water bath 11. As shown, a metallic, rectilinear enclosure or casing 18 encompasses the entire water chamber and fire box 14 and a lower portion of the stack 16. A vertical interior casing wall 20, together with top, bottom and side walls of the casing 18, define a control box 24, and a removable front control box cover panel 22 in parallel spaced relationship to the interior casing wall 20 forms an access door to the control box.

The water chamber 12 includes a cylindrical watertight main shell or inner liner 13; a flat, disc-shaped water chamber bottom plate also serving as a top fire box plate 15; and a flat, disc-shaped water chamber top plate 17. A plurality of vertical flues 26 (9 as shown) open through the water chamber 12 from position in sealing relationship to plate 15 to sealing relationship to plate 17.

The top and vertical side walls of the water chamber 12 and a top edge portion of the fire box 14 are covered with a layer of heat insulating material 25 within casing 18; but the lower portion of the walls of the fire box are not so insulated.

As shown, the heat source in combustion chamber or fire box 14 is a plurality of gas burners or jets 30 receiving their fuel from a fuel pipe 32, and receiving combustion air through a plurality of lower louvers 34 provided in a lower portion of the front control box cover panel 22. A portion 19 of the main shell 13 extending below the water chamber bottom plate 15 serves to separate the fire box 14 from the control box 24, and a baffle plate 35 is provided with slots so that it can be adjustably mounted to portion 19 to have at least ⅛ inch clearance off the bottom of a bottom deck 21 of the vaporizer thus to provide control over the amount of combustion air reaching the burners 30.

A plurality of upper louvers 36 are provided in an upper portion of panel 22 to cooperate with lower louvers 34 in a manner to be explained.

Figure 3:
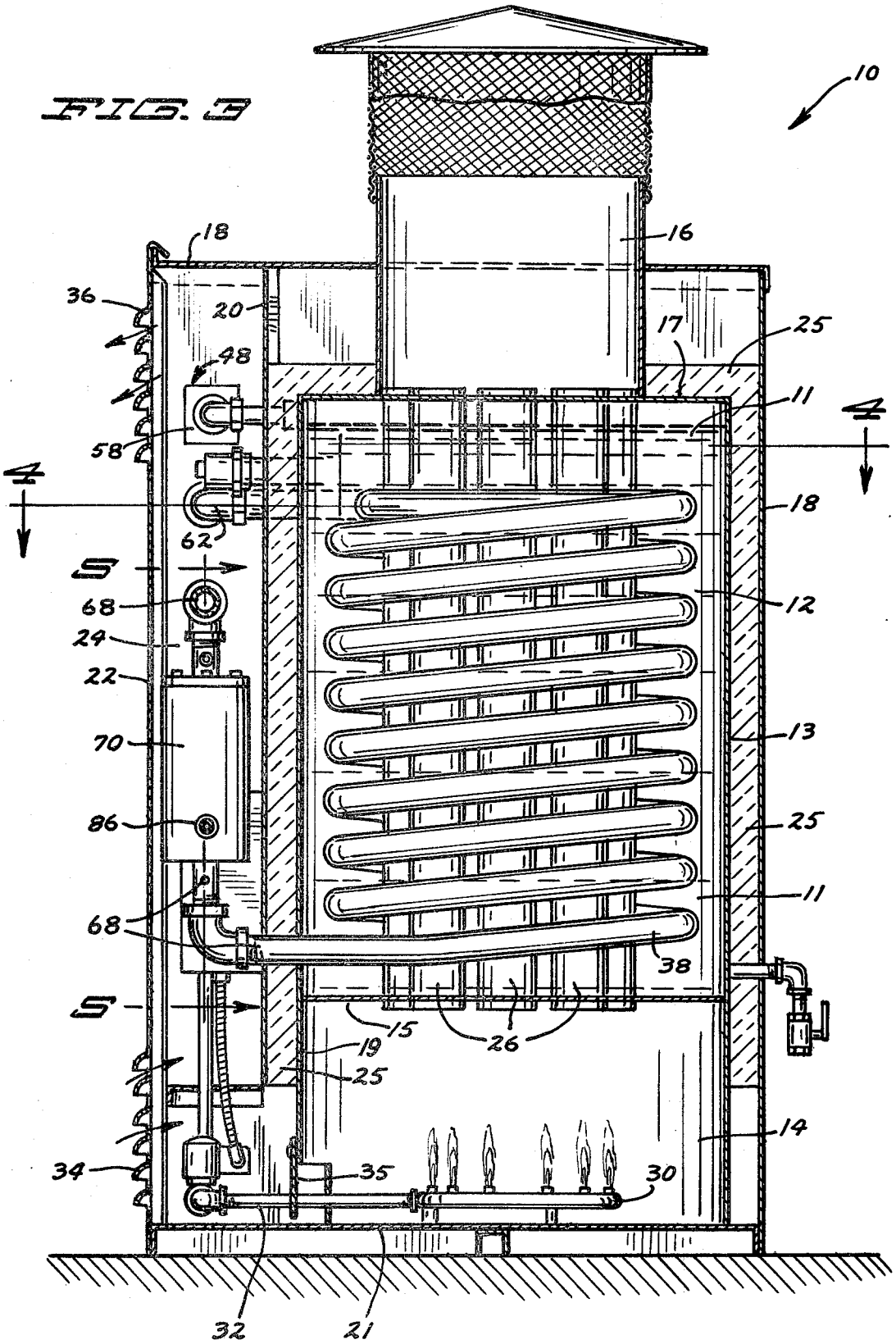
FIG. 3 is an enlarged vertical sectional view taken from the right in FIG. 1 and on the line 3—3 in FIG. 4.

A helically wound heat transfer pipe or helix 38 is connected through an upper portion of the water chamber 12, and through the control box 24 to a liquid propane supply pipe or inlet pipe 62. This helix 38 is connected through a bottom portion of the water chamber and a bottom portion of the control box to a gaseous propane delivery pipe or outlet pipe 68. As best seen in FIGS. 3 and 4, the helix 38 is positioned in the water chamber 12 to have its major axis concentric with the axis of the cylindrical main shell 13 of the water chamber. The vertical flues 26 extend up through the center of the helix as they extend up through the center of the water chamber. Also as best seen in FIG. 3, the flues all open into the stack 16.

A filler and breather attachment 48 includes a breather pipe 54 which is open to the interior of the water chamber 12 at the top edge of the chamber and extends into the control box 24 on a slightly upward run to open to an integral vertical filler pipe 50 situated outside of the casing 18. This filler pipe 50 is covered with a removable filler cap 52 which will allow passage of water vapor and/or air to equalize the pressure inside of the water chamber with respect to atmospheric pressure. The filler pipe and filler cap combination can, if desired, include an oil bath arrangement whereby passage of air into the filler and breather attachment 48 or passage of water vapor and air out of the breather attachment is accomplished through such an oil bath. Such an oil bath structure can be of any usual or preferred design.

Spaced apart, substantially vertical heat conducting fins 58 extend radially outwardly from the breather pipe 54 and conduct heat away from the breather pipe to tend to cool the contents of the breather pipe to the end that vapor passing off on the top of the water chamber will be condensed on the inside of the pipe and will run back along the inside of the breather pipe and back into the water chamber rather than to pass out through the filler pipe and the filler cap to be lost to the water bath.

Liquid propane enters the liquid supply pipe or inlet pipe 62 through a globe shutoff valve 60 and through a strainer 59 from a source of liquid propane under regulated pressure (not shown). It is heated as it passes through the helix 38 in the water bath 11 in water chamber 12. As it absorbs sufficient heat, it passes from the liquid phase to the vapor phase and is forced out of the heat transfer pipe or helix 38 through gaseous delivery pipe or outlet pipe 68 to a location for use (not shown) by the incoming liquid propane. As best seen in FIGS. 2 and 3, gaseous propane delivery pipe 68 has a vertical run inside of the control box 24, and in that run is situated a liquid cut-off float valve 70. This valve includes a cylindrical valve body 72 having a plurality of vertical, spaced apart float-positioning flat ribs 74 integral with the interior of the valve body and extending radially inwardly therefrom. The inner edges of these ribs define a cylindrical envelope within which a part-cylindrical valve float 76 is free to move vertically.

A cage 78 is situated at the bottom of the float valve 70 inside of the valve body 72 in position to prevent the float 76 from coming into sealing and closing relationship with respect to the portion of the vertical run of the outlet pipe 68 at the bottom of the valve 70. The cage includes upright support legs 77 spaced around the pipe 68 as it opens to the bottom of the valve body 72; and a horizontal baffle plate 79 supported on the legs 77 and positioned vertically over the upwardly open end of pipe 68 in position to deflect vaporized propane flowing up through valve 70 from pipe 68. This baffle plate 79 prevents the high velocity of the vaporized propane from lifting the float and so closing the valve 70 under full vapor flow conditions.

A conical valve seat 80 is provided in valve 70 between the valve body 72 and the upper portion of the vertical run of the outlet pipe 68. A replaceable sphere or ball 82 is affixed to the top of the float 76 to move with it into and out of sealing relationship with respect to the valve seat 80.

Figure 6:
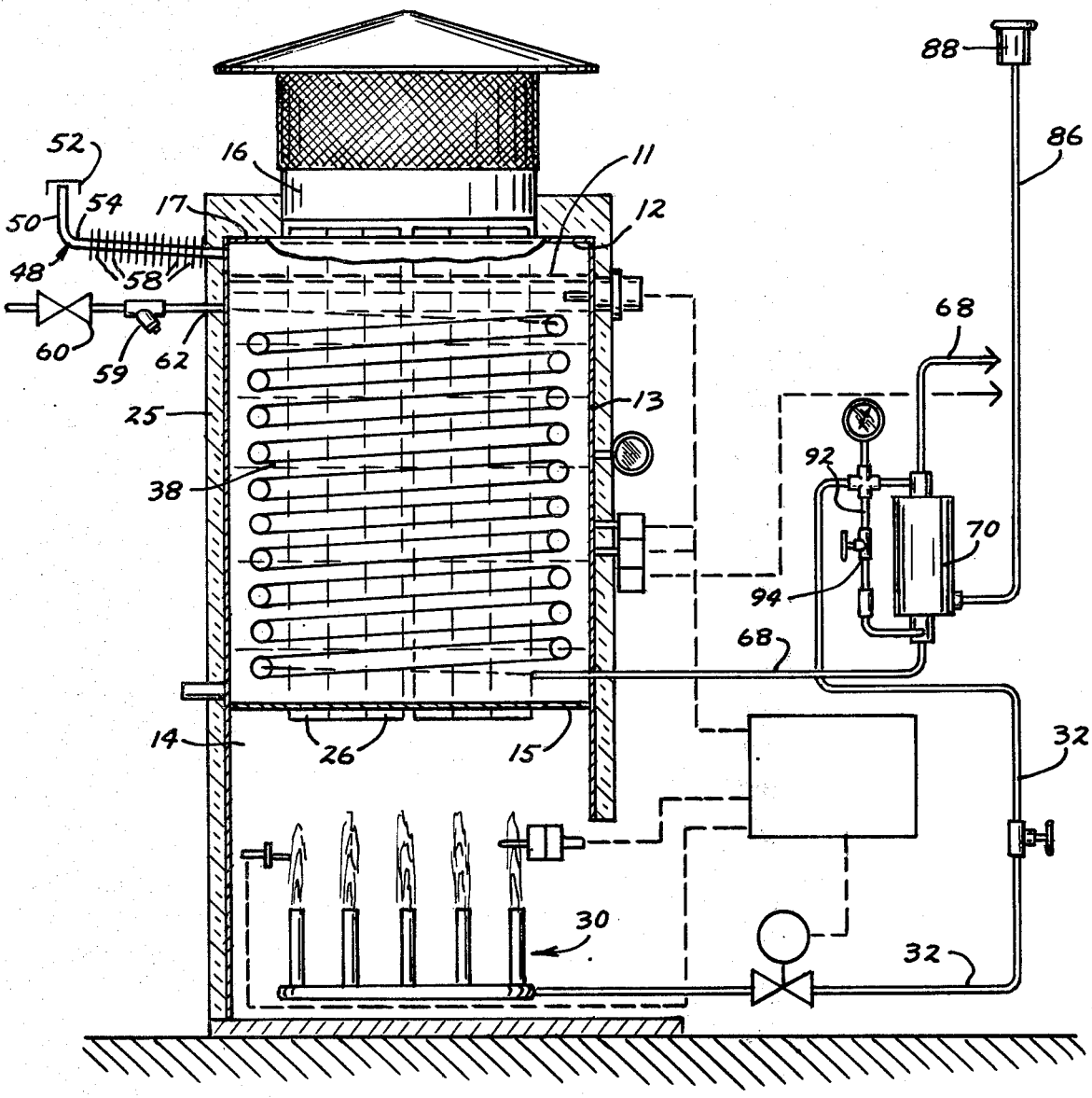
FIG. 6 is a schematic representation of the flow diagram and some of the controls for the vaporizer of the invention.

As best seen in FIGS. 5 and 6, the fuel for firing gas burners 30 can be obtained from fuel pipe 32 opening from outlet pipe 68 above the liquid cut-off float valve 70. Suitable control and safety valves are provided in the fuel pipe 32.

A bypass pipe 92 also extends from the outlet pipe 68 above the liquid cut-off float valve 70 to the outlet pipe 68 below that float valve 70. A normally closed bypass needle valve 94 is located in bypass pipe 92.

As long as there is gaseous propane being delivered from the gaseous propane delivery pipe or outlet pipe 68, the float 76 will rest on top of cage 78, as indicated in dotted lines in FIG. 5, and that gaseous propane will pass freely through the vertical run of the outlet pipe 68 including valve 70. At the time of start-up, and whenever the demand for gaseous propane from the outlet pipe 68 exceeds the ability of the vaporizer 10 to produce, liquid propane will flow into the liquid cut-off float valve 70 from the bottom through the outlet pipe 68, and will cause the float 76 to rise on top of the liquid. When sufficient liquid propane has built up in the valve 70, the sphere or ball 82 will be forced up into sealing relationship with respect to the valve seat 80, and the flow out through outlet pipe 68 will be cut off.

If and when the vaporizer becomes flooded with such a cold water bath condition, there should be vapor present on the outlet side of the float valve 70. To put the vaporizer back into operation, the burner 30 will be ignited to heat the water bath. As the water bath temperature increases, the propane liquid in the heat transfer pipe or helix 38 will vaporizer and expansion will force the liquid propane back into the liquid propane supply pipe or inlet pipe 62. The normally closed bypass needle valve 94 will be slightly opened or "cracked" to provide burners 30 with additional gas as needed through fuel pipe 32. In this manner, all liquid in the gaseous propane delivery pipe or outlet pipe 68, including that in the liquid cut-off float valve 70, and liquid in the helix 38 will be vaporized. If the pressure differential between the inlet and the outlet of the float valve 70 will not allow the valve float 76 and ball or sphere 82 to move to open condition, this pressure is equalized by opening normally closed bypass needle valve 94.

As clearly seen in FIGS. 2 and 4, the liquid cut-off float valve 70 is situated inside of control box 24 and gaseous propane is delivered out through the top of it and through outlet pipe 68 to any desired location for use outside of the control box.

The ball 82 could be made of a number of materials, but nylon has been found to be particularly satisfactory for the purpose. For purposes of illustration, the float 76 is illustrated as if there were liquid propane in the valve 70 to the level indicated at 84. Under normal operations, of course, the float 76 would be resting on the top of cage 78, and there would be no constriction to the passage of gas through the valve seat 80 by the ball 82.

An emergency pressure relief pipe 86 extends from float valve 70 to an emergency relief valve 88.

With the vaporizer 10 in dynamic operation and delivering gaseous propane in the manner described, it has been found that the hottest portions of the water bath 11 are at the top of the water bath. Therefore, it has been found that the introduction of the liquid propane through the liquid propane supply pipe or inlet pipe 62 into the top of the helix provides the maximum possible temperature gradient at the outset, and this has been found to provide the maximum turbulent effect (boiling) inside of the heat transfer pipe or helix. Maximum turbulence, and therefore minimum laminar flow, at this point results in maximizing the heat exchange.

Also, introduction of the relatively cold liquid propane into the helix at the top of the water bath tends to cause rapid cooling of the water and consequent flow down toward the fire box, probably down the outer wall of the main shell 13 outside the helix 38. Coupled with the flow of hot water up from the fire box probably mostly inside of the helix and along the flues 26, this action substantially inhibits or prevents horizontal thermal stratification.

The water bath 11 can, in temperate climates, be made up entirely of water, but in areas where the ambient temperatures can drop below 32° (0° C), sufficient ethylene glycol or other water freeze point depressant will be used to prevent any danger of freezing inside the water chamber. The boiling point of the water bath 11 will be in the general neighborhood of 212° F (100° C). The volume of production of gaseous propane is, of course, determined by the rate at which heat can be transferred through the water bath to the propane. The more turbulence and the more rapid the heat transfer pipe 38, the more energy which can be absorbed into the water bath without causing it to boil over and off through the filler and breather attachment 48.

In FIG. 6, the various electronic and other controls are illustrated, and the various electrical conduits are schematically represented with dotted lines. These controls, conduits and control lines and pipes can be of any usual or preferred construction, directly forming no part of the present invention. However, it is to be noted that all of these controls are situated inside of control box 24, as shown or suggested in FIG. 2. As perhaps best seen in FIGS. 2 and 3, the fire box 14 is not insulated from the bottom portions of the control box 24, and a certain amount of heat from the fire box will move by radiation, convection and/or conduction from the fire box to a bottom portion of the control box. Also, the portion of outlet pipe 68 as it passes from the helix 38 through a bottom portion of the cylindrical main shell 13 of the water chamber through the insulation 25 and into the control box is relatively hot because it is carrying off the heated gases. This heat at lower portions of the control box induces a flow of air from lower louvers 34, vertically up through the control box 24, and out of upper louvers 36 in the control box cover panel 22. This flow of warmed air has a warming, evaporating and drying effect on all of the electronic and gas controls, and control conduits, lines and pipes; and tends to prohibit or at least severely inhibit tendencies for deterioration due to corrosion and rusting and the like of these elements inside of the control box.

The embodiments of the invention in which an exclusive property or privilege is claimed are defined as follows:

1. Vaporizer apparatus for converting liquefied gas into vapor phase, said apparatus including:

A. a fire box;

B. a liquid heat exchange chamber vertically above the fire box, said liquid heat exchange chamber including:

(1) a main substantially vertically shell wall, (2) a bottom wall, (3) a top wall, and (4) means to introduce a liquid heat exchange medium into said chamber;

C. a stack extending upwardly from said liquid heat exchange chamber;

D. a plurality of vertical flues in sealing relation to said bottom heat exchange chamber wall and to said top wall and open from said fire box through said liquid heat exchange chamber and through said top heat exchange chamber wall into said stack;

E. a liquefied gas supply pipe adapted to supply liquefied gas under pressure;

F. a gaseous delivery pipe adapted to deliver vaporized gas to a location for use;

G. a heat transfer pipe including a helically wound portion positioned in said liquid heat exchange chamber to lie in surrounding relation to said vertical flues, said liquefied gas supply pipe extending through a wall of the liquid heat exchange chamber to a top end of said helix and a bottom end of said helix extending through a wall of the liquid heat exchange chamber to said gaseous delivery pipe;

H. means to introduce heat energy into said fire box; and

I. means to block flow of liquefied gas out of said gaseous delivery pipe responsive to the presence of liquid in said gaseous delivery pipe.

2. The apparatus of claim 1 wherein said means to block flow of said liquefied gas out of said gaseous delivery pipe includes a vertical section of gaseous delivery pipe and a liquid cut-off float valve forming a part of said vertical section of said delivery pipe; said float valve including:

J. a vertically extending float valve body;

K. a float mounted in said body for vertical movement therein responsive to the level of liquefied gas in said body;

L. a valve seat provided in an upper part of said float valve body and providing an opening between the interior of said valve body and a delivery portion of said delivery pipe; and M. a valve mounted to move responsive to movement of said float between a blocking relationship with respect to said valve seat when a high level of liquefied gas exists in said float valve body, and a clearing relationship with respect to said valve seat when a lower level or no level of liquefied gas exists in said valve body.

3. The apparatus of claim 2:

N. a bypass pipe open from said gaseous delivery pipe above the float valve to said gaseous delivery pipe below the float valve; and O. a normally closed pressure equalizing bypass valve in the bypass pipe, said bypass valve being operable to equalize the pressure across the liquid cut-off float valve.

4. The apparatus of claim 1 wherein:

J. wherein said vertical shell wall and said top wall of said liquid heat exchange chamber are encased in heat insulating material;

K. wherein said fire box, heat exchange chamber with insulating material and a lower portion of said stack are encompassed by an outer casing;

L. wherein said outer casing also provides a control box in adjacent spaced relation to said heat change chamber and above said fire box in heat receiving relation to said fire box;

M. an openable control box access cover panel positioned to cooperate with said outer casing to provide a closed control box cavity, a lower portion of said control box and cover panel being provided with a lower louver opening to allow passage of ambient air into the box and an upper portion of said control box and cover panel being provided with an upper louver opening to allow passage of air heated by its proximity to the fire box to pass out of the box; and N. wherein said means to introduce heat into said fire box and said means to block flow of liquefied gas out of said gaseous delivery pipe includes controls situated within said cavity in said control box.

5. The apparatus of claim 4 wherein said means to block flow of said liquefied gas out of said gaseous delivery pipe includes a vertical section of said gaseous delivery pipe and a liquid cut-off float valve forming a part of said vertical section of said delivery pipe; said float valve being located in said control box and including:

O. a vertically extending float valve body;

P. a float mounted in said body for vertical movement therein responsive to the level of liquefied gas in said body;

Q. a valve seat provided in an upper part of said float valve body and providing an opening between the interior of said valve body and a delivery portion of said delivery pipe; and R. a valve mounted to move responsive to movement of said float between a blocking relationship with respect to said valve seat when a high level of liquefied gas exists in said float valve body, and a clearing relationship with respect to said valve seat when a lower level or no level of liquefied gas exists in said valve body.

6. The apparatus of claim 1 wherein said means to block flow of liquefied gas out of said gaseous delivery pipe includes a vertical section of said gaseous delivery pipe and a liquid cut-off float valve forming a part of said vertical section of said delivery pipe; said float valve including:

J. a vertically extending float valve body;

K. a plurality of inwardly extending ribs inside of said body, inner ends of said ribs defining a vertical, float-guiding envelope;

L. a float within said valve body, said float having a configuration to fit within and to move freely vertically with respect to said inner ends of said ribs;

M. a valve seat provided in an upper part of said valve body and providing an opening between the interior of the valve body and a delivery portion of of said delivery pipe;

N. a valve situated at an upper end of said float in position to move between a blocking relationship with respect to said valve seat when a high level of liquefied gas exists in the float valve body, and a clearing relation with respect to said valve seat when a lower level or no level of liquefied gas exists in the valve body;

O. a lower portion of said valve body being open to an inlet portion of said delivery pipe; and P. a fluid pervious cage mounted in the valve body vertically below the float in position to intercept the float as liquefied gas leaves the valve body to drain back into the inlet portion of the delivery pipe, thus to prevent the float from tending to block the opening between the float valve body and the inlet portion of the delivery pipe.

7. The apparatus of claim 6 wherein said cage includes a baffle plate in operational, flow-receiving alignment with said inlet portion of said delivery pipe and in spaced relation thereto.

8. The apparatus of claim 6 wherein:

Q. the float is part cylindrical;

R. the envelope defined by the inner ends of the ribs is in encompassing relation to the float and is cylindrical;

S. said valve seat is of an upwardly converging conical configuration; and

T. said valve is at least part spherical in configuration.

9. The vaporizer apparatus of claim 1 wherein said means to introduce a liquid heat exchange medium into said liquid heat exchange chamber includes:

A. a filler and breather attachment having a breather pipe open to an upper end portion of said liquid heat exchange chamber and extending away from said heat exchange chamber at a slight upward angle with respect to the horizontal;

B. a vertical filler pipe open to the outer end of the breather pipe and extending upwardly therefrom; and C. a plurality of parallel, spaced apart heat conducting fins in heat conductive relationship with respect to the breather pipe.

10. The apparatus of claim 9 and a removable filler cap over the upper end of said vertical filler pipe.

* * * * *